US007387693B2

(12) United States Patent
Brazzi

(10) Patent No.: US 7,387,693 B2
(45) Date of Patent: Jun. 17, 2008

(54) METHOD OF ALTERING THE RESISTIVITY OF A METAL WIRE

(76) Inventor: Daniele Brazzi, 7 Tara Lawns, Kinnegad (IE)

( * ) Notice: Subject to any disclaimer, the term of this patent is extended or adjusted under 35 U.S.C. 154(b) by 6 days.

(21) Appl. No.: 11/460,693

(22) Filed: Jul. 28, 2006

(65) Prior Publication Data

US 2007/0146111 A1 Jun. 28, 2007

(51) Int. Cl.
*C21D 9/52* (2006.01)

(52) U.S. Cl. ..... 148/576

(58) Field of Classification Search ..... 148/576
See application file for complete search history.

*Primary Examiner*—Evan Pert
(74) *Attorney, Agent, or Firm*—Michael P. Mazza

(57) ABSTRACT

A method for altering the resistance of a length of metal wire is disclosed.

3 Claims, 1 Drawing Sheet

METHOD OF ALTERING THE RESISTIVITY OF A METAL WIRE

Figure 1:
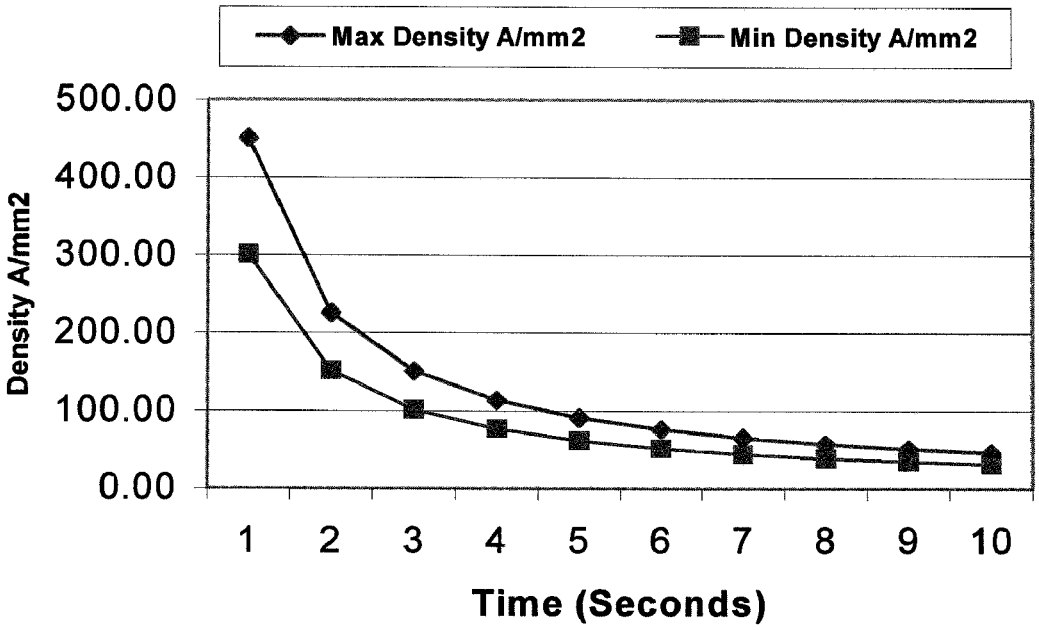

This invention relates to a method of altering the resistance of a length of metal wire.

The invention, therefore, provides a method of altering the resistance of a length of a metal wire having a length L and having a first end and a second end; the wire having a room (ambient) temperature resistance of R ohms, the method comprising the step of applying to the ends of the wire a DC voltage V volts at a current of I amps with the first end of the wire being connected to the positive pole of the DC source and the second end of the wire being connected to the negative pole of the DC source according to the formulae $$V=R*I; \text{ and}$$

$$I=\sqrt{(P/R)}$$

$$P=Q/T \text{ where } Q=m*cs*\Delta t$$

where m=the total mass of the wire derived from, the formula m=ps*Vc;

ps is the density of the wire;

Vc is the volume of the wire;

cs is the specific heat of the wire;

Δt the difference in temperature between the room (ambient) temperature and a temperature selected above ambient that is less than the destruction temperature of the wire; and T is the time in seconds for which the current I at the voltage V is applied;

whereby after said application of voltage and current, the resistance of the wire when compared with the initial resistance R is found to be reduced when the first end is connected to the positive pole of a DC source and the second end is connected to the negative pole of the DC source; the resistance of the wire is found to be increased when the first end is connected to the negative pole of a DC source and the second end is connected to the positive pole of the DC source.

Preferably, the metal is copper having

R=11Ω at 25° C.

L=53 m;

Ø=0.33 mm ps=8.94/cm3 and where

T=10 seconds;

I=3.77 A; and

V=41.42V DC;

cs=386 Jkg ° K; and

Δt=100° C.

Preferably, the metal is copper having

R=11Ω at 25° C.;

L=53 m;

Ø=0.33 mm;

ps=8.94 g/cm$^3$;

and where

T=10 seconds;

I=2.73 A;

V=30V DC;

cs=386 Jkg ° K; and

Δt=45° C.

An embodiment of the invention will now be described in respect of a copper wire having a length of 53 m; a weight of 110 g; a diameter of 0.33 mm; and R=11Ω.

The voltage and current to be applied to the ends of the wire are according to the formulae $$V=R*I \text{ and}$$

$$I=\sqrt{(P/R)}$$

Where P=Q/T; Q=m*cs*Δt.

M=the total mass of the wire derived from the formulae m=ps*Vc;

ps=the density of the wire;

Vc=the volume of the wire;

cs=the specific heat of the wire.

Δt=the difference in temperature (copy page 1 last paragraph)

T=the time in seconds for which the current I and the voltage V is applied.

t=25° C.

ps=8.94 g/cm$^3$

Vc=4.5 cm$^3$

R=11Ω cs=386 J

T=10 seconds

For Δt=100° C. and substituting.

$$m=ps*Vc=8.94 \text{ g/cm}^3*4.5 \text{ cm}^3=40.49 \text{ g}=0.0405 \text{ kg}$$

$$Q=m*cs*\Delta t=0.0405 \text{ kg}*386 \text{ Jkg } ^\circ \text{ K}*100^\circ \text{ C.}$$
$$1563.23 \text{ J}$$

As 1 watt=1 J/s, thus for 10 seconds, $$p=1563.23/10=156.3 \text{ W}$$

Thus the current I=$\sqrt{(156.3/11)}$=3.77 A and the voltage V=11*3.77=41.46V.

Accordingly, by connecting the first end of the wire to the positive pole of a DC source and the second end of the wire to the negative pole of the DC source, and applying 41.46 v at a current of 3.77 A for 10 seconds, the resistance of the wire at 25° C. was now found to be altered compared with an initial resistance of 11Ω. Thus, following the application of the voltage and current, when the first end was connected to the positive pole of a DC source and the second end was connected to the negative pole of the DC source the resistance of the wire was found to be reduced by at least 2% of 11Ω, When the second end was connected to the positive pole of the DC source and the first end was connected to the negative pole of the DC source, the conductivity was found to be the resistance of the wire was found to be increased by at least 2% of 11Ω.

For Δt=45° C., and substituting as above I=2.53 A and V=27.8V with T=10 seconds, the resistance of the wire was altered when compared with the initial resistance of 11Ω when the first end was connected to the positive pole of a DC source and the second end was connected to the negative pole of a DC source, the resistance was found to be reduced by at least 2% of 11Ω. When the first end was connected to the negative pole the DC source and the second end was connected to the positive pole of the DC source, the resistance was found to be increased by at least 2% of 11Ω.

After the application of the method the metal will increase its tolerance to the density of current per mm$^2$ by at least 2%. Furthermore, the resistance of the metal will decrease by at least 2% of its original value and due to this lower resistance the metal will generate less heat compared to its original state.

The invention is not limited to the embodiments described which can undergo considerable variation without departing from the scope of the invention.

A reduction of at least 2% of the resistance of the conductor (copper wire) is achieved with a current density greater than 30 A per $mm^2$. This current density value, which has been found by way of laboratory experiments, is, therefore, the minimum current density applicable below which no reduction of resistance is possible even if the time (T) is increased beyond 10 seconds. Therefore it can be said that the minimum electrical current (Ampère) needed to obtain at least a 2% reduction of resistance is equal to:

$$\text{Ampère}/mm^2 * T = 30*10 = 300\ A/sec/mm^2$$

The graph depicted in FIG. 1 shows the relationship of minimum and maximum current density over time.

Min Density=minimum current below which no reduction of resistance is possible.

Max Density=maximum current with copper wire as specified in claim 1.

Above the graph line "minimum density" all the various combinations of current density/time will result in a reduction of resistance.

The invention claimed is:

1. A method of altering the resistance of a length of a metal wire having a length L and having a first end and a second end, the wire having a room (ambient) temperature resistance of R ohms, the method comprising the step of applying to the ends of the wire a DC voltage V volts at a current of I amps according to the formulae $$V = R*I;\ \text{and}$$

$$I = \sqrt{(P/R)}$$

where R is the resistance of the wire at room (ambient) temperature t;

$$P = Q/T \text{ where } Q = m*cs*\Delta t$$

where m=the total mass of the wire derived from the formula m=ps*Vc;

ps is the density of the wire;

Vc is the volume of the wire;

cs is the specific heat of the wire;

Δt the difference in temperature between the room (ambient) temperature and a temperature selected above ambient that is less than the destruction temperature of the wire; and T is the time in seconds for which the current I at the voltage V is applied; whereby after said application of voltage and current, the resistance of the wire when compared with the initial resistance R is found to be reduced when the first end is connected to the positive pole of a DC source and the second end is connected to the negative pole of the DC source; the resistance of the wire is increased when the first end is connected to the negative pole of a DC source and the second end is connected to the positive pole of the DC source.

2. A method as claimed in claim 1 wherein the metal is copper having

R=11Ω at 25° C.;

L=53 m;

Ø=0.33 mm;

ps=8.94/cm3; and where

T=10 seconds;

I=3.77 A;

V=42V DC;

cs=386 Jkg ° K; and

Δt=100° C.

3. A method as claimed in claim 1 wherein the metal is copper having

R=11Ω at 25° C.;

L=53 m;

Ø=0.33 mm;

ps=8.94 $g/cm^3$; and where

T=10 seconds;

I=2.73 A;

V=30V DC;

cs=386 Jkg ° K; and

Δt=45° C.

* * * * *